US010337450B2

(12) United States Patent
Laqua et al.

(10) Patent No.: US 10,337,450 B2
(45) Date of Patent: Jul. 2, 2019

(54) GAP GEOMETRY IN A COHESIVELY JOINED COOLING-CHANNEL PISTON

(71) Applicant: KS Kolbenschmidt GmbH, Neckarsulm (DE)

(72) Inventors: Matthias Laqua, Bad Wimpfen (DE); Volker Lehnert, Obereisesheim (DE)

(73) Assignee: KS Kolbenschmidt GmbH, Neckarsulm (DE)

( * ) Notice: Subject to any disclaimer, the term of this patent is extended or adjusted under 35 U.S.C. 154(b) by 51 days.

(21) Appl. No.: 15/323,368

(22) PCT Filed: Jul. 2, 2015

(86) PCT No.: PCT/EP2015/065146

§ 371 (c)(1),
(2) Date: Dec. 30, 2016

(87) PCT Pub. No.: WO2016/001379

PCT Pub. Date: Jan. 7, 2016

(65) Prior Publication Data

US 2017/0138297 A1 May 18, 2017

(30) Foreign Application Priority Data

Jul. 2, 2014 (DE) ..... 10 2014 212 769

(51) Int. Cl.
*F02F 3/22* (2006.01)
*F02F 3/00* (2006.01)

(52) U.S. Cl.
CPC ..... *F02F 3/22* (2013.01); *F02F 3/003* (2013.01); *F02F 2003/0061* (2013.01)

(58) Field of Classification Search
CPC ..... F02F 3/22; F02F 3/003; F02F 2003/0061
USPC ..... 123/193.6, 41.35
See application file for complete search history.

(56) References Cited

U.S. PATENT DOCUMENTS 6,698,391 B1 * 3/2004 Kemnitz ..... F02F 3/003 123/193.6
2009/0151555 A1 6/2009 Lapp et al.
2010/0275873 A1 * 11/2010 Gniesmer ..... B23K 20/129 123/193.6

(Continued)

FOREIGN PATENT DOCUMENTS

DE 10047258 A1 4/2002
EP 1180592 A2 2/2002
WO 2012/083929 A2 6/2012

*Primary Examiner* — Marguerite J McMahon
(74) *Attorney, Agent, or Firm* — Young Basile Hanlon & MacFarlane, P.C.

(57) ABSTRACT

The invention relates to a cooling-channel piston for an internal combustion engine, having an upper part and a lower part, wherein the upper part and the lower part are connected to one another by way of a cohesive joint in the form of a weld seam, and the upper part and the lower part form an annularly encircling cooling channel which is arranged approximately behind a ring section, wherein a gap geometry is provided between a lower edge of the ring section and an upper edge of the lower part, wherein the gap geometry has at least one sliding surface which is arranged on a lower edge of the ring section of the cooling-channel piston and/or on the corresponding upper edge of the lower part of the cooling-channel piston, and to several methods for the operation of a cooling-channel piston.

20 Claims, 5 Drawing Sheets

(56) References Cited

U.S. PATENT DOCUMENTS

2013/0133610 A1* 5/2013 Gniesmer ..... B21K 1/18
123/193.6

* cited by examiner

GAP GEOMETRY IN A COHESIVELY JOINED COOLING-CHANNEL PISTON

TECHNICAL FIELD

The invention relates to a cooling-channel piston for internal combustion engines, having a gap geometry in a cohesively joined cooling channel and several methods to operate a cooling-channel piston in accordance with the features of the respective preambles of the independent claims.

BACKGROUND

This cooling-channel piston has an upper part and a lower part, wherein these two parts are connected to each other by way of a cohesive joint, specifically friction welding. After being joined, these two parts form an annular, circumferential cooling channel that is located approximately behind a ring belt. As an option, the cooling-channel piston can have a cooling chamber, transfer passages between cooling channel and cooling chamber, as well as cooling pockets. No cooling chamber, no transfer passage and no cooling pockets are required in order to implement the teaching of this document.

Friction welding of upper part and lower part is particularly preferred. Other methods of joining or connecting, such as electron beam welding, bonding, clamping, bolting or similar can also be applied.

A cooling-channel piston is known from WO 2006/034862 A1 that consists of an upper part and a lower part. These two parts are permanently attached using a friction welded joint. An annular cooling channel is formed by the upper part and the lower part (can also be formed by only one of the parts) and is located approximately behind a ring belt.

The ring belt terminates in the upper part (facing/towards/) the lower part in a circumferential ring wall that can be supported via a gap geometry on a matching abutting/contact surface of the lower part, which is also circumferential.

In this prior art a corresponding gap geometry is shown in FIGS. 1 to 4.

Using this gap geometry, it must be ensured during operation of the cooling-channel piston in the internal combustion engine that the outer area of the upper part below the ring belt is supported on the corresponding upward facing area of the lower part, in particular in the skirt area. At the same time, it must be ensured with this gap geometry that the cooling medium present in the annular cooling channel during operation of the cooling-channel piston in the internal combustion engine, which is being circulated and exchanged, does not escape by way of this gap geometry.

These gap geometries, however, as described in WO 2006/034862 A1, have significant disadvantages.

The part of the gap area that extends in the direction of the annular cooling channel can no longer be checked and no longer be reworked/refinished if upper part and lower part are joined permanently to each other, in particular when employing friction welding. This area is no longer accessible following the joining process. If it should turn out that, as a result of manufacturing (or even possibly during operation of the cooling-channel piston), this gap area or even the entire gap area is too small, the upper part bears on the lower part when loaded under the force of gas pressure. As a result stresses are created that can result in cracks forming in the connecting joint, in particular the friction weld joint. If, on the other hand, the gap is too large, the cooling medium can force its way outwards in undesirable amounts through this gap towards the cylinder wall.

SUMMARY

The object of the invention is, therefore, to provide a cooling-channel piston that does not possess the aforementioned disadvantages as well as several methods for operating a corresponding cooling-channel piston.

This object is achieved by a cooling-channel piston and several methods having the features of the independent claims.

In accordance with the invention, a cooling-channel piston for an internal combustion engine is planned having an upper part and a lower part wherein these two parts are connected to each other by a cohesive joint, and these two parts form an annular circumferential cooling channel that is located approximately behind a ring belt, wherein a gap geometry is planned between a lower edge of the ring belt and an upper edge of a lower part, wherein the gap geometry has a least one sliding surface that is located at a lower edge of the ring belt of the cooling-channel piston and/or at the corresponding upper edge of a lower part of the cooling-channel piston.

By means of at least one gap in the gap geometry, the introduction of forces into the cohesive joint between upper part and lower part of the cooling-channel piston is avoided. If they do make contact, however, measures are in place to prevent damage to the cooling-channel piston. For example, stress cracks in the cohesive joint during operation of the cooling-channel piston in an internal combustion engine are forestalled. The cohesive joint can be a weld seam. If different materials are used for upper part and lower part, the at least one gap can act as an expansion joint when the materials expand at different rates. The at least one gap is designed in such a way that upper part and lower part of the cooling-channel piston do not come into contact in the area between the upper edge of the lower part and the lower edge of the ring belt following manufacture and preferably also not during operation of the internal combustion engine.

However, if there is an application of force parallel, or almost parallel to the piston stroke axis that result in contact or a touch between the lower edge of the ring belt of the cooling-channel piston and the corresponding upper edge of a lower part of the cooling-channel piston, at least one sliding surface is planned. This at least one sliding surface allows the two parts to slide along this at least one sliding surface. The controlled application of force results in deformation of at least one element having a sliding surface. Independently of the intensity of the applied force and the material used and the geometry of the two sliding parts, the deformation of the element having at least one sliding surface can be reversed. This element having at least one sliding surface can be located on the upper part and/or on the lower part of the cooling-channel piston. The deformation of the element having at least one sliding surface takes place preferably by deflection of the element towards the piston stroke axis or opposite to the piston stroke axis. More than one element having at least one sliding surface can be affected by the deflection. For example, several elements can avoid each other or slide along each other in opposite directions by deflection of the respective element. In this way, stress cracks in the cohesive joint between upper part and lower part of the cooling-channel piston are avoided. In addition, this achieves a controlled deformation, by deflection for example, of the area containing the ring belt in the event of excessive application of force. This area can deflect towards the piston stroke axis or away from the piston stroke axis towards the cylinder wall. In both cases sufficient space is provided to allow further operation of the internal combustion engine.

Further provision is made for the gap geometry to have a gap with a variable gap dimension. This gap dimension can be varied depending on the demands on the internal combustion engine or the specifications of the internal combustion engine in which the cooling-channel piston is used. For example, the power and displacement of the internal combustion engine. The choice of material influences the gap dimension to be set. Different areas of application for the internal combustion engine with a cooling-channel piston in accordance with the invention can influence the gap dimension to be set. In addition, reference is made to different climatic conditions in which the internal combustion engine is to be operated. The use of the internal combustion engine with a matching cooling-channel piston as a stationary machine for generating energy, or in different vehicles, for example passenger cars, trucks, locomotives, traction units or ships, taking account of specific operating parameters, can influence the gap dimension to be set. Choosing a suitable gap dimension ensures that upper part and lower part preferably do not touch in the area of the gap geometry during operation of the internal combustion engine.

Alternatively, provision is made in accordance with the invention for the lower edge of the ring belt of the cooling-channel piston and/or the corresponding upper edge of a lower part of the cooling channel piston to have a curvilinear shape. If the lower edge of the ring belt touches the upper edge of the lower part, the curvilinear shape of the lower edge prevents direct transmission of force in this area into the lower part of the cooling-channel piston. The lower edge of the ring belt slides off the upper edge of the lower part facing it along its curvilinear path. For example, the area of the upper part with the ring belt deflects towards the piston stroke axis. This effectively prevents the cooling-channel piston in the cylinder of the internal combustion engine from seizing. The internal combustion engine can continue to operate.

Provision is further made in accordance with the invention for a projection to be provided on the side of the ring belt facing the cooling channel. This projection forms a circumferential bead protruding into the cooling channel. This bead reinforces the ring belt lying opposite it. Depending on the geometric shape of the projection, it advantageously acts to direct the cooling medium within the cooling channel. For example, one can cite a triangle-shaped geometry in section through the circumferential projection. In the case of this triangular shape for the projection, the tip of the triangle would point towards the piston stroke axis. Polyhedron-shaped forms in cross-section for the projection are also conceivable. Likewise, the projection can assume a curvilinear path in cross-section, wherein one rising and one falling flank are to be provided.

Provision is further made in accordance with the invention for the projection to have a curvilinear shape. The curvilinear shape of the projection in turn allows a controlled slide on a preferably chamfered upper edge of the lower part to prevent an unacceptable introduction of force into the lower part of the cooling-channel piston. The curvilinear shape of the projection allow a controlled deflection of the area of the upper part surrounding the ring belt in the event of unacceptable introduction of force into the upper part of the cooling-channel piston. The section with the ring belt deflects in this case towards the cylinder wall. However, sufficient space is provided to prevent the piston from seizing in the cylinder as a result of this distortion.

Provision is further made in accordance with the invention for the projection to form a contoured guide for the cooling medium. This effectively prevents the cooling medium from passing through the gap geometry during the upward and downward motion of the cooling-channel piston. The cooling medium coming from cooling pockets is guided past the gap geometry. Cooling medium coming from the opposite direction is also guided past the gap geometry. The contoured guide can assume a curvilinear shape in cross-section, whereby the cooling medium is steered respectively in another direction during the upward and downward motion of the cooling-channel piston, preferably in a direction diagonally to the piston stroke axis.

Provision is further made in accordance with the invention for a gap inside the gap geometry that separates upper part and lower part to have an upper gap dimension which is greater than a lower gap dimension. Thus a greater gap dimension is provided in the expected principal direction of force along the piston stroke axis to forestall contact of the lower edge of the ring belt with the upper edge of the lower part.

Provision is further made in accordance with the invention for the at least one gap of the gap geometry to have at least one section with an alignment parallel to the piston stroke axis or almost parallel to the piston stroke axis. This vertical or almost vertical alignment of the section effectively prevents cooling medium from passing through the gap geometry.

In accordance with the invention a method is provided for operating a cooling-channel piston for internal combustion engines, wherein the cooling medium is guided by means of a gap geometry with a contoured guide around said gap geometry. In this way, the cooling medium is prevented from passing through the gap geometry while the internal combustion engine is operating. This method makes it possible to retain the cooling medium inside the cooling channel so that it is available in its entirety for heat exchange.

Provision is further made in accordance with the invention for the projection to be formed as a contoured guide for the cooling medium, wherein a defined direction of flow for the cooling medium is effected during the upward motion of the cooling channel piston and a defined direction of flow for the cooling medium is effected during the downward motion of the cooling channel piston. Rising cooling medium is guided more quickly towards the combustion bowl to absorb the principal volume of heat from the combustion process. If the cooling channel piston has optimal cooling pockets, rising cooling medium is also conveyed more quickly towards cooling pockets. Heated cooling medium in turn is taken more quickly out of the heat exchange area.

In accordance with the invention a method is provided to operate a cooling-channel piston, in particular for internal combustion engines, wherein in the event of contact between upper part and lower part of the cooling-channel piston as the result of applied force, at least one sliding surface on the upper part and/or lower part causes upper part and lower part to slide over one another.

The geometric configuration of the lower edge of the ring belt prevents unacceptable transmission of force into the lower part in the event of contact with the upper edge of the lower part. As a result of the curvilinear configuration of the lower edge of the ring belt, this lower edge deflects selectively either towards the piston stroke axis or towards the cylinder wall. This depends on the preferred direction which is dependent on the shape of the curve. In both cases, continued operation of the internal combustion engine is possible.

In accordance with the invention a method is provided to operate a cooling-channel piston, wherein upper part and lower part slide along a curvilinear sliding surface. The curvilinear configuration of the lower part prevents a failure of an internal combustion engine with a cooling-channel piston in the event of an overload. As a result of this advantageous geometric configuration of the gap geometry, unacceptable introduction of force in a direction parallel to the piston stroke axis or in an almost parallel direction to the piston stroke axis into the lower part in the area of the lower edge of the ring belt is avoided. Introduction of force results in deformation of the area of the upper part with the ring belt, but not to a failure of the internal combustion engine.

In order to avoid the disadvantages described at the outset, it is absolutely imperative that the entire extent of the gap, or at least a part of it, is implemented horizontally (i.e. at a right angle to the piston stroke axis). Alternatively, the cooling medium must be prevented by measures or geometries from entering the gap during the upward and downward motion of the piston.

If the gap, starting from the cooling channel towards the outside of the cooling-channel piston, were to run from top to bottom, or from bottom to top, the cooling medium is accelerated during the upward and downward motion (Shaker effect) and thus flung at high speed out of the cooling channel above the gap towards the ring belt or the skirt, that is to say outwards.

Furthermore, the ring belt must have the opportunity, and be configured and be suitable for this, to deflect appropriately in the event of a too high gas load (e.g. during knocking) and a resulting coming together of the two facing contours of upper part and lower part in order to prevent stress peaks in the weld zone of the cohesive joint.

Embodiments of the invention are shown in the Figures and described in what follows.

Figure 1:
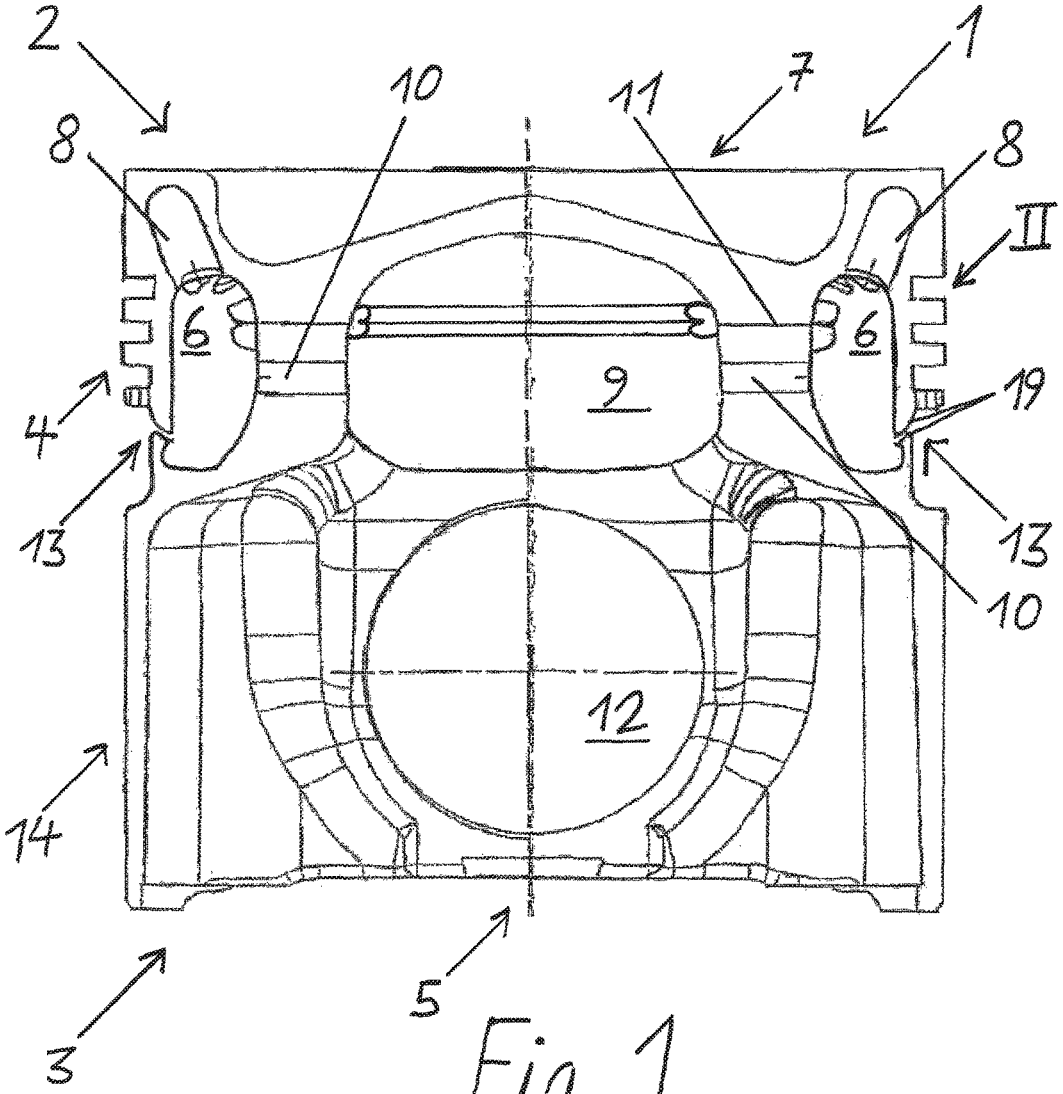
FIG. 1 shows a piston with a gap geometry.

In the following description of the Figures, terms such as up, down, above, below, left, right, front, back refer solely to the representation chosen as an example and the position of the device in the respective Figures. These terms are not to be understood as restrictive, that is to say these references can change as the result of different positions and/or mirror-image layout or similar.

Identical parts are given identical reference numerals in all the Figures.

DETAILED DESCRIPTION

Figure 3:
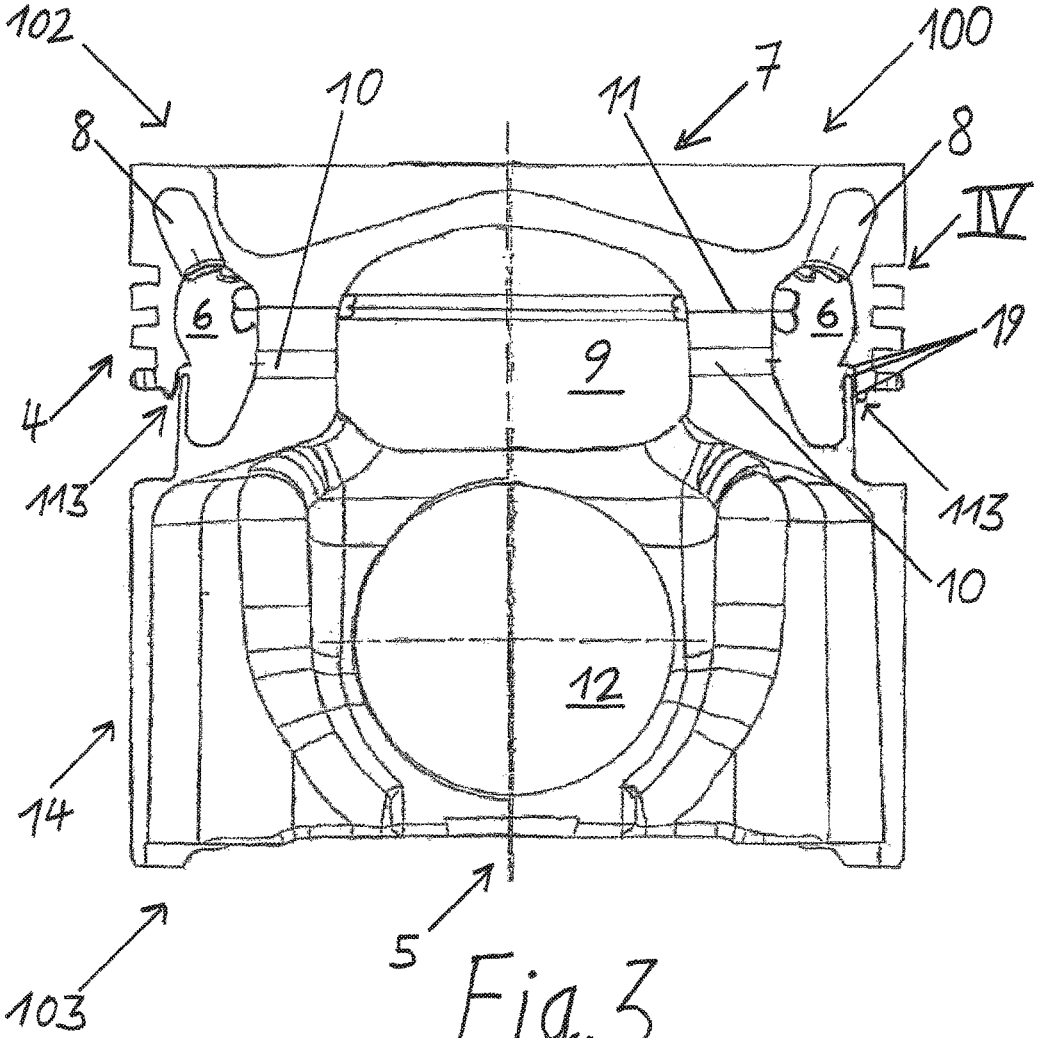
FIG. 3 shows a further embodiment of a piston with a gap geometry.

FIG. 1 shows a cooling-channel piston 1 and FIG. 3 shows a cooling-channel piston 100. Cooling-channel piston 1 has an upper part 2 and lower part 3. Cooling-channel piston 100 has an upper part 102 and a lower part 103. Both cooling-channel piston 1, 100 have a ring belt 4 to receive piston rings (not shown). Adjacent the ring belt 4 in the direction of a central piston stroke axis 5 there is a cooling channel to receive a cooling medium, preferably to receive oil. The piston upper part 2, 102 and the piston lower part 3, 103 are connected to each other by means of a friction-weld joint.

After these two parts 2, 3; 102, 103 have been joined, they form the circumferential, annular cooling channel 6 which is located approximately behind the ring belt. Cooling pockets 8 adjoin the cooling channel 6 in the direction of a combustion bowl 7. These cooling pockets 8 are optional and may be, but do not have to be, present. These cooling pockets 8 are wetted by the cooling medium during the upward and downward motion of the cooling-channel piston 1, 100. A cooling chamber 9, connected to the cooling channel 6, is located centrally below the combustion bowl 7. Transfer passages 10 provide the connection between the cooling channel 6 and the cooling chamber 9. These transfer passages 10 may be, but do not have to be, present. It is conceivable to design the cooling channel 6 without transfer passages 10 and/or cooling pockets 8. Even the cooling chamber 9 is optional and may therefore be present, but does not have to be present. A weld seam 11 joins the upper parts 2, 102 to the lower parts 3, 103 of the cooling-channel piston 1, 100. Piston pin bores 12 are located below the cooling chamber 9 to receive piston pins (not shown).

A gap geometry 13 is located below the ring belt 4 in the area where the upper part 2 and the lower part 3 of the cooling-channel piston 1 make contact. A gap geometry is provided between the upper part 102 and the lower part 103 of the cooling-channel piston 100 below the ring belt 4. A skirt and boss area 14 adjoins the gap geometries 3, 113. The gap geometries 13, 113 have at least one sliding surface 19 which is located at a lower edge 16 of the ring belt 4 of the cooling-channel piston 1, 100 and/or at the corresponding upper edge 17 of a lower part 3, 103 of the cooling-channel piston 1, 100. The lower edge 16 of the ring belt 4 of the cooling-channel piston 1, 100 and/or the corresponding upper edge 17 of a lower part 3, 103 of the cooling-channel piston 1, 100 can trace a diagonal path with respect to the piston stroke axis 5, or a curvilinear path.

All geometric forms which allow the lower edge 16 of the ring belt 4 of the cooling-channel piston 1, 100 and/or the corresponding upper edge 17 of a lower part 3, 103 of the cooling-channel piston 1, 100 to slide on each other are similarly conceivable.

Figure 2A:
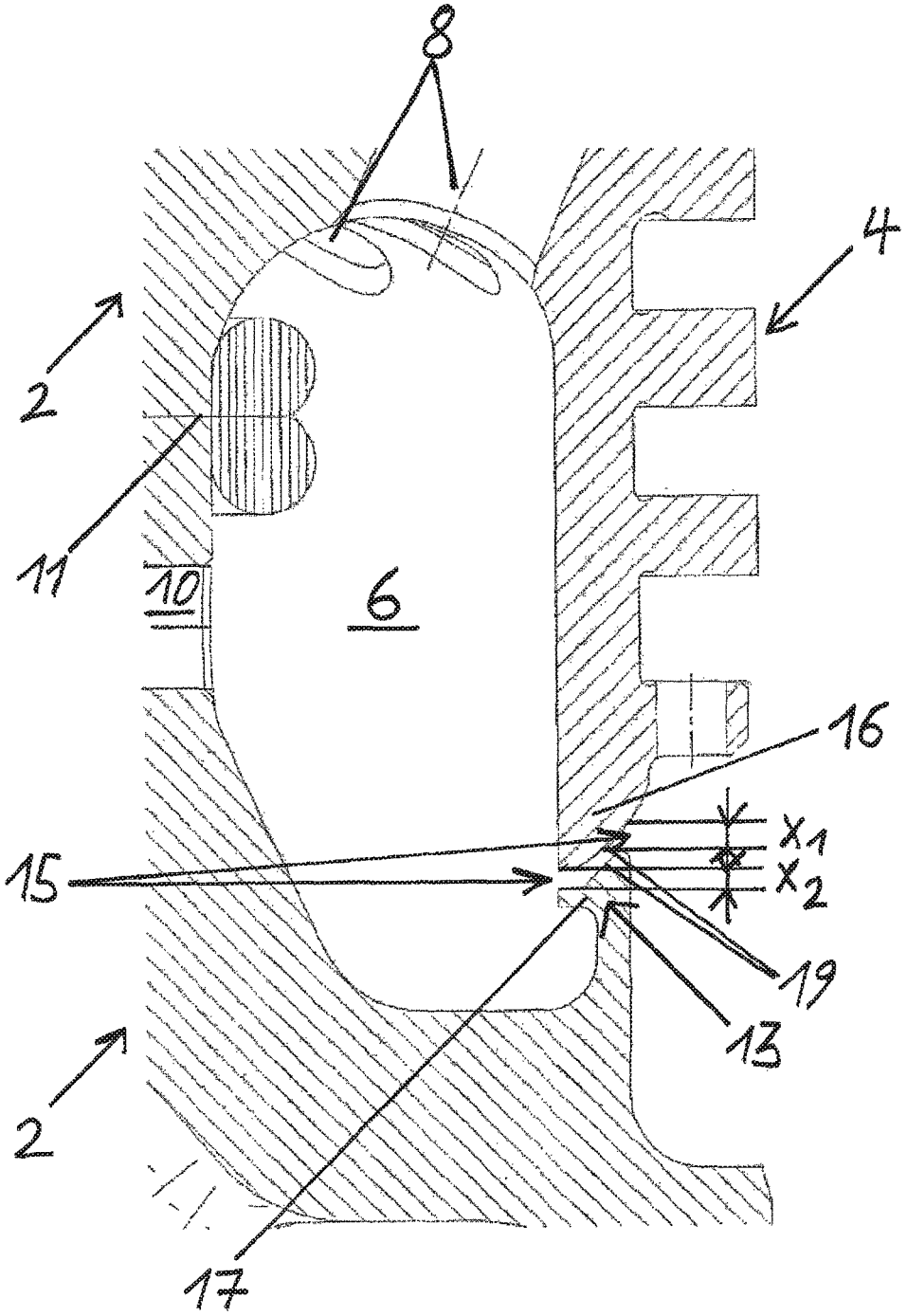
FIGS. 2A and 2B show a detail identified by II in FIG. 1.
Figure 2B:
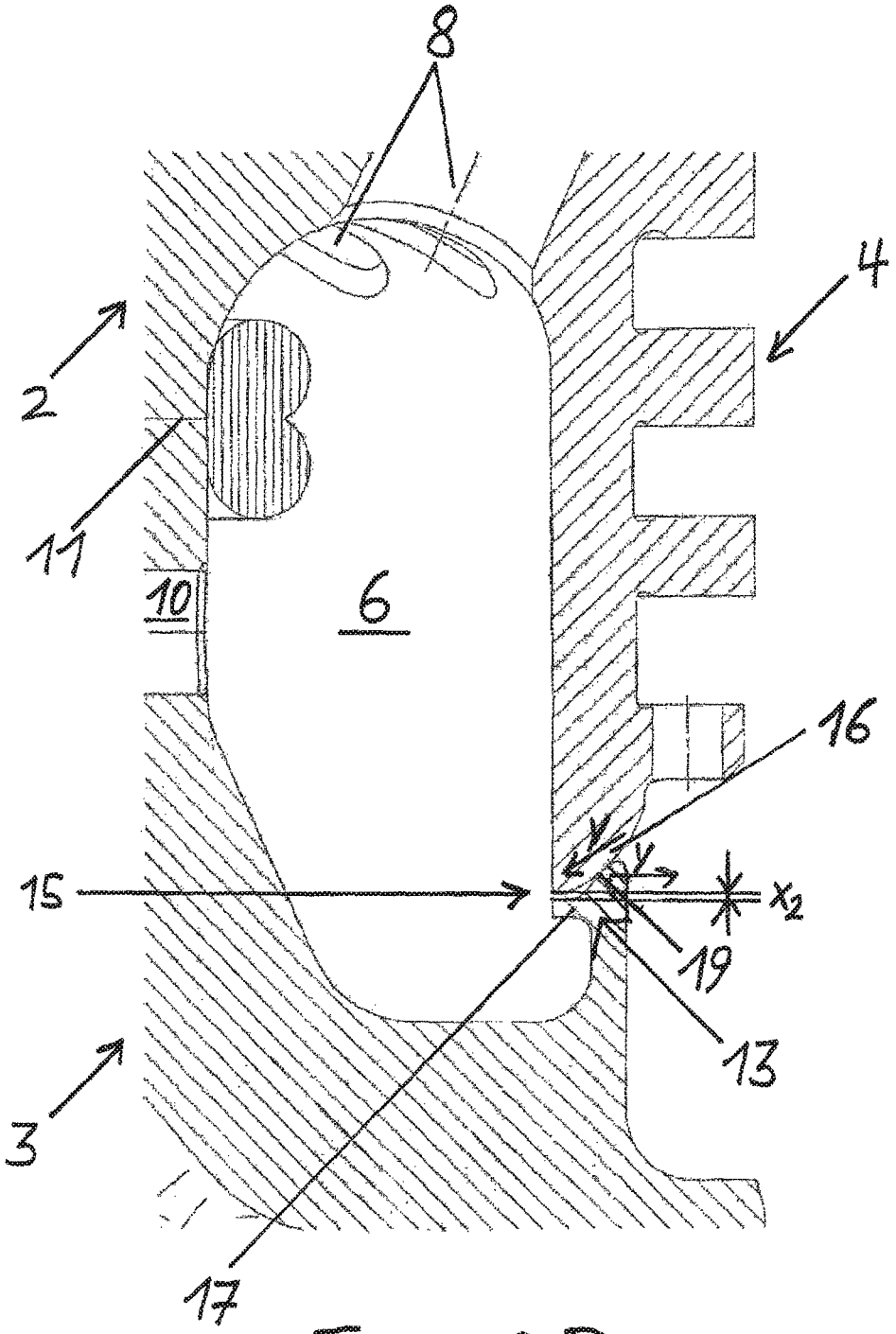
Figure 4:
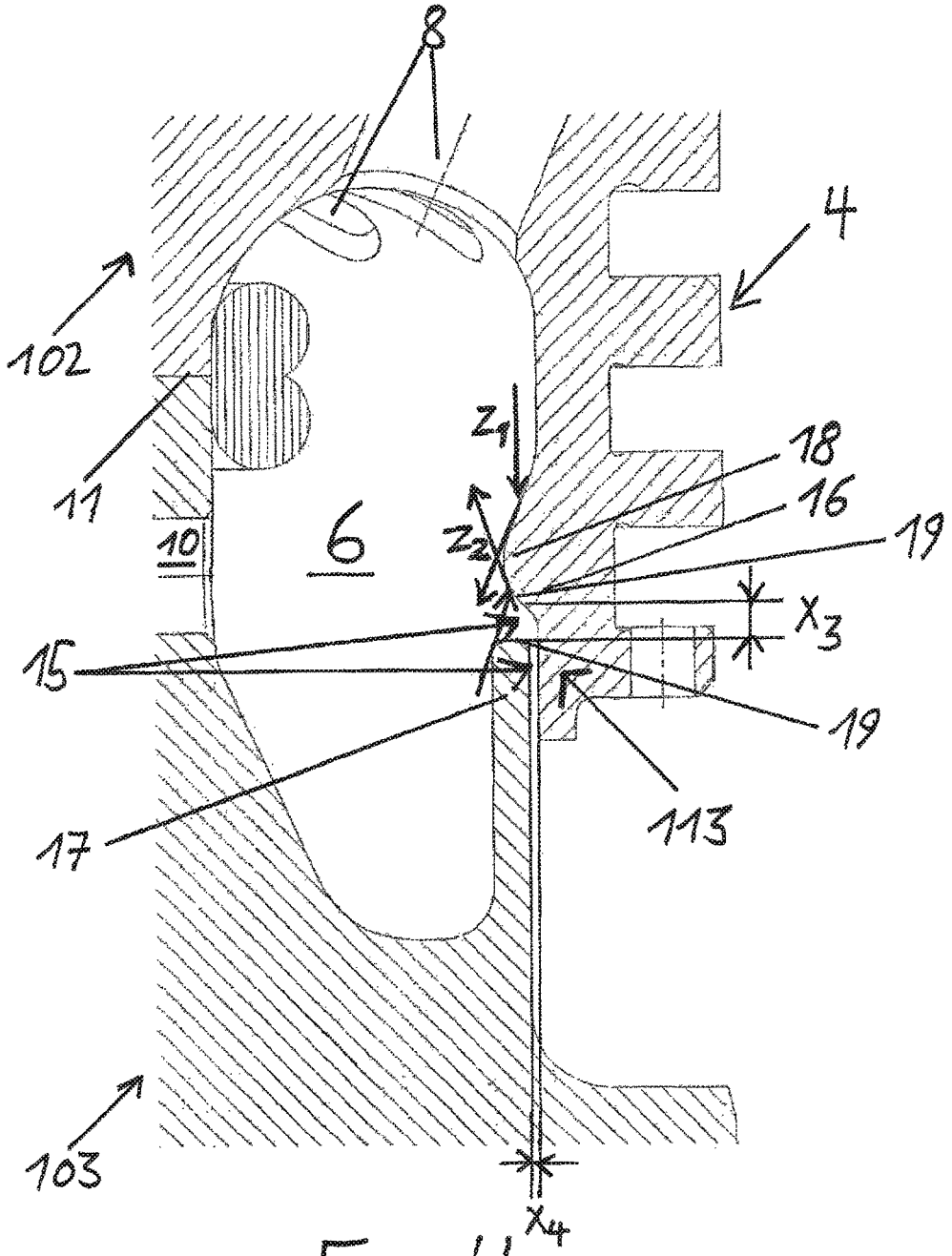
FIG. 4 shows a detail identified by IV in FIG. 3.

The embodiments of the gap geometries 13, 113 in accordance with the invention are described in greater detail in what follows. FIGS. 2A and 2B show the gap geometry 13 as a detail identified in FIG. 1 by II. FIG. 4 shows the gap geometry 113 as a detail identified in FIG. 3 by IV.

In order to avoid the disadvantages described at the beginning, or to achieve the corresponding benefits, a first gap geometry 13 is shown in FIGS. 1, 2A and 2B, and a further gap geometry 113 is shown in FIGS. 3 and 4. Common to these gap geometries, that are located below the ring belt 4 of the upper part 2, 102 and above the skirt and boss area 14 of the lower part 3, 103, is the fact that they form a defined gap geometry $X_1$, $X_2$, $X_3$, $X_4$ (e.g. FIGS. 2A and 4) during each operating state of the cooling-channel piston 1, 100 (e.g. during a cold start, under heavy load, and during normal operation). An upper gap dimension $X_1$, $X_3$ is, for example, designed to be larger in each case than a lower gap dimension $X_2$, $X_4$. The geometry 3, 113 of the gap area and the clearance, i.e. the gap opening, is selected such that the cooling medium is prevented from penetrating the gap area due to the upward and downward motion of the cooling-channel piston 1, 100, or the gap area is so small that either no volume of cooling medium or only the smallest possible, only just acceptable volume of cooling medium can escape.

In addition, the gap geometry 13, 113 and the clearance are selected such that the areas facing each other (lower edge 16 of the ring belt 4 and/or upper edge 17 of the lower part 3, 103) can deflect if they contact each other to prevent the upper part 2, 102 from bearing unduly on the lower part 3, 103. This circumstance is shown in FIG. 2B. There the lower edge 16 of the ring belt 4 is coming to bear on the upper edge 17 of the lower part 3. Consequently, the gap dimension $X_1$ no longer exists and is therefore not drawn in. The gap dimension $X_2$ shrinks from the dimension shown in FIG. 2A to the dimension shown in FIG. 2B. Y indicates the direction of motion of the lower edge 16 of the ring belt 4 and the direction of motion of the upper edge 17 of the lower part 3 under an unduly high load. In order to obviate resulting damage to the cooling-channel piston 1 and a subsequent failure of the internal combustion engine, the lower edge 16 of the ring belt 4 is of a curvilinear shape. As a result of this curvilinear shape, the lower edge of the ring belt 4 slides off on the upper edge 17 of the lower part 3. This controlled deformation in the area of the ring belt 4 prevents failure of the internal combustion engine in which a correspondingly shaped cooling-channel piston 1 is used. Normal operating conditions for an internal combustion engine, however, do not result in the aforementioned deformation in the area of the lower edge 16 of the ring belt 4 of a cooling-channel piston 1. This safety precaution, however, guarantees that even abnormal operating conditions of an internal combustion engine with a cooling-channel piston 1 do not lead to a failure of this internal combustion engine.

The projection 18 formed in the area of the lower edge 16 of the ring belt 4 of the gap geometry 113 shown in FIG. 4 also follows a curvilinear path. Under an appropriate load, which, however, is not foreseen in normal operation of an internal combustion engine with a cooling-channel piston 100, the projection 18 slides off on the chamfered area of the upper edge 17 of the lower part 103. This also effectively prevents a failure of the internal combustion engine that is operated with a cooling-channel piston 100. The upper part 102 is precluded from bearing unduly on the lower part 103.

Finally, the geometry 3, 113 in FIGS. 2A and 4 is selected for normal operating conditions such that upper part 2, 102 and lower part 3, 103 are stopped from being able to bear on each other in the area of the gap geometry 13, 113. FIGS. 2A and 4 thus show the gap geometries 13, 113 in their normal state.

At the same time, the gap geometry 13, 113 is selected such that under the prevailing operating conditions of the cooling-channel piston a gap 15, even if only a minimal gap, is maintained, but at the same time the cooling medium is prevented from being able to penetrate into the gap area and on towards the piston skirt. This is achieved by a specific geometry and, as a result, precise regulation of the cooling medium during the upward and downward motion of the cooling-channel piston 100 in the internal combustion engine.

Z represents the direction of motion of the cooling medium during the upward and downward motion of the cooling-channel piston 100. The cooling medium flow is steered by a projection 18 that is located at the ring belt on the cooling channel side in such a way that it cannot pass through the gap 15, or the gap geometry 113. $Z_1$ identifies the direction in which the cooling medium flows during the upward motion of the cooling-channel piston 100. $Z_2$ identifies the direction in which the cooling medium flows during the downward motion of the cooling-channel piston 100. The projection 18 thus forms a contoured guide at the gap geometry 113 for the cooling medium during operation of the internal combustion engine.

A list of reference numbers used in the figures follows:

1 Cooling-channel piston
100 Cooling-channel piston
2 Upper part
102 Upper part
3 Lower part
103 Lower part
4 Ring belt
5 Piston stroke axis
6 Cooling channel
7 Combustion bowl
8 Cooling pocket
9 Cooling space
10 Transfer passage
11 Weld seam
12 Piston pin bore
13 Gap geometry
113 Gap geometry
14 Skirt and boss area
15 Gap
16 Lower edge
17 Upper edge
18 Projection
19 Sliding surface
$X_1$ Upper gap dimension
$X_2$ Lower gap dimension
$X_3$ Upper gap dimension
$X_4$ Lower gap dimension
Y Direction of motion
$Z_1$ Direction of flow of cooling medium during upward motion of the cooling-channel piston
$Z_2$ Direction of flow of cooling medium during downward motion of the cooling-channel piston

What is claimed is:

1. A cooling-channel piston for an internal combustion engine, having an upper part and a lower part, wherein the upper part and the lower part are connected to one another by way of a cohesive joint in a form of a weld seam and the upper part and the lower part form an annular circumferential cooling channel that is located behind a ring belt, wherein a gap geometry is provided between a lower edge of the ring belt and an upper edge of the lower part, wherein the gap geometry has at least one sliding surface that is arranged on a lower edge of the ring belt of the cooling-channel piston and/or on the corresponding upper edge of a lower part of the cooling-channel piston.

2. The cooling-channel piston from claim 1, wherein the lower edge of the ring belt of the cooling-channel piston and/or the corresponding upper edge of the lower part of the cooling-channel piston follows a diagonal path with respect to a piston stroke axis.

3. The cooling-channel piston from claim 1, wherein the lower edge of the ring belt of the cooling-channel piston and/or the corresponding upper edge of the lower part of the cooling-channel piston follows a curvilinear path.

4. The cooling-channel piston from claim 1, wherein a projection is provided on a side of the ring belt facing the cooling channel.

5. The cooling-channel piston from claim 4, wherein the projection follows a curvilinear path.

6. The cooling-channel piston from claim 4, wherein the projection forms a contoured guide for a cooling medium.

7. The cooling-channel piston from claim 4, wherein the lower edge of the ring belt of the cooling-channel piston and/or the corresponding upper edge of the lower part of the cooling-channel piston follows a diagonal path with respect to a piston stroke axis.

8. The cooling-channel piston from claim 4, wherein the lower edge of the ring belt of the cooling-channel piston and/or the corresponding upper edge of the lower part of the cooling-channel piston follows a curvilinear path.

9. The cooling-channel piston from claim 4, having a gap within the gap geometry that separates the upper part and the lower part, wherein a separation between the upper part and the lower part is greater at an upper end of the gap than at a lower end of the gap.

10. The cooling-channel piston from claim 1, having a gap within the gap geometry that separates the upper part and the lower part, wherein a separation between the upper part and the lower part is greater at an upper end of the gap than at a lower end of the gap.

11. The cooling-channel piston from claim 10, wherein at least one section of the gap separating the upper part and the lower part is parallel to a piston stroke axis.

12. The cooling-channel piston from claim 10, wherein the lower edge of the ring belt of the cooling-channel piston and/or the corresponding upper edge of the lower part of the cooling-channel piston follows a diagonal path with respect to a piston stroke axis.

13. The cooling-channel piston from claim 10, wherein the lower edge of the ring belt of the cooling-channel piston and/or the corresponding upper edge of the lower part of the cooling-channel piston follows a curvilinear path.

14. A method for operating the cooling-channel piston for internal combustion engines in accordance with claim 1, wherein the gap geometry has a contoured guide that guides a cooling medium around the gap geometry.

15. The method from claim 14, wherein a projection is provided on a side of the ring belt facing the cooling channel.

16. The method from claim 15, wherein the projection is configured as a contoured guide for the cooling medium, wherein a defined direction of flow for the cooling medium during upward motion of the cooling-channel piston and another defined direction of flow for the cooling medium during downward motion of the cooling-channel piston is achieved.

17. A method for operating a cooling-channel piston for internal combustion engines in accordance with claim 1, wherein in the event of contact between the upper part and the lower part of the cooling-channel piston, at least one sliding surface arranged on the upper part and/or lower part enables the upper part and the lower part to slide relative to one another.

18. The method from claim 17, wherein the upper part and the lower part slide along a curvilinear sliding surface.

19. The cooling-channel piston from claim 1, wherein the lower edge of the ring belt of the cooling-channel piston and/or the corresponding upper edge of the lower part of the cooling-channel piston follows a diagonal path with respect to a piston stroke axis;

wherein the lower edge of the ring belt of the cooling-channel piston and/or the corresponding upper edge of the lower part of the cooling-channel piston follows a curvilinear path;

wherein a projection is provided on a side of the ring belt facing the cooling channel; and wherein a gap within the gap geometry that separates the upper part and the lower part has an upper gap dimension that is greater than a lower gap dimension.

20. The cooling channel piston from claim 1 wherein the at least one sliding surface allows at least one of the upper part or the lower part to slide along the at least one sliding surface towards a piston stroke axis or opposite to the piston stroke axis.

* * * * *